US010033088B2

(12) United States Patent
Zhang et al.

(10) Patent No.: US 10,033,088 B2
(45) Date of Patent: Jul. 24, 2018

(54) ANTENNA UNIT AND TERMINAL

(71) Applicant: ZTE CORPORATION, Shenzhen, Guangdong Province (CN)

(72) Inventors: Lu Zhang, Shenzhen (CN); Wei Li, Shenzhen (CN)

(73) Assignee: Xi'An Zhongxing New Software Co., Ltd., Xi'An (CN)

( * ) Notice: Subject to any disclaimer, the term of this patent is extended or adjusted under 35 U.S.C. 154(b) by 15 days.

(21) Appl. No.: 15/113,224

(22) PCT Filed: May 26, 2014

(86) PCT No.: PCT/CN2014/078464
§ 371 (c)(1),
(2) Date: Jul. 21, 2016

(87) PCT Pub. No.: WO2015/109706
PCT Pub. Date: Jul. 30, 2015

(65) Prior Publication Data

US 2017/0012345 A1 Jan. 12, 2017

(30) Foreign Application Priority Data

Jan. 24, 2014 (CN) ..... 2014 1 0035207

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 1/521* (2013.01); *H01Q 9/42* (2013.01)

(58) Field of Classification Search
CPC ..... H01Q 1/243; H01Q 1/38; H01Q 9/0421; H01Q 1/12; H01Q 1/42
(Continued)

(56) References Cited

U.S. PATENT DOCUMENTS

2012/0274522 A1* 11/2012 Ayatollahi ..... H01Q 1/243 343/745
2013/0069842 A1* 3/2013 Lee ..... H01Q 21/28 343/853
2013/0300629 A1* 11/2013 Jiang ..... H01Q 1/50 343/853

FOREIGN PATENT DOCUMENTS

CN 102025025 A 4/2011
CN 102104193 A 6/2011
(Continued)

OTHER PUBLICATIONS

Office Action dated Jul. 11, 2017 for Japanese Patent Application No. 2016-548169.
(Continued)

*Primary Examiner* — Dameon E Levi
*Assistant Examiner* — Collin Dawkins
(74) *Attorney, Agent, or Firm* — Plumsea Law Group, LLC

(57) ABSTRACT

The present document discloses an antenna unit and a terminal. The antenna unit disclosed by the present document includes an antenna circuit board, at least two neighboring antennas and an electromagnetic coupling module used for isolating coupling signal transmission between two neighboring antennas, wherein the electromagnetic coupling module is connected in series between the two neighboring antennas. The present document uses the electromagnetic coupling module to isolate signal transmission between the two neighboring antennas, i.e., electric signals in the two antennas are unable to be transmitted to opposite end,
(Continued)

thereby reducing signal coupling between the neighboring antennas and improving the isolation between the two neighboring antennas.

9 Claims, 7 Drawing Sheets

(51) Int. Cl.
*H01Q 1/52* (2006.01)
*H01Q 9/42* (2006.01)

(58) Field of Classification Search
USPC ..... 343/702, 853, 878, 872
See application file for complete search history.

(56) References Cited

FOREIGN PATENT DOCUMENTS

| | | | |
|---|---|---|---|
| CN | 103022690 | A | 4/2013 |
| JP | 2001308620 | A | 11/2001 |
| WO | 2008131157 | A1 | 10/2008 |
| WO | 2011/142135 | A1 | 11/2011 |

OTHER PUBLICATIONS

International Search Report dated Oct. 29, 2014 in PCT Patent Application No. PCT/CN2014/078464.
European Search Report dated Dec. 15, 2016 for European Patent Application No. EP14879479.5.

* cited by examiner

ANTENNA UNIT AND TERMINAL

CROSS-REFERENCE TO RELATED APPLICATION(S)

This application is the U.S. National Phase application of PCT application number PCT/CN2014/078464 having a PCT filing date of May 26, 2014, which claims priority of Chinese patent application 201410035207.2 filed on Jan. 24, 2014, the disclosures of which are hereby incorporated by reference.

TECHNICAL FIELD

The present document relates to the application field of mobile wireless communication technologies, in particular an antenna unit and a terminal.

BACKGROUND OF RELATED ART

In recent years, with the popularization and development of mobile terminals, new communication systems continuously pursue higher transmission rate and greater channel capacity. In 4G communication systems (Long Term Evolution (LTE) and evolved LTE-A, Worldwide Interoperability for Microwave Access (WiMAX) systems, etc.), a Multi-Input Multi-Output (MIMO) antenna technology becomes a core feature for improving data rate. It generally refers to that a plurality of antennas are deployed at a receiving end and a transmitting end of a wireless communication system and a plurality of parallel transmission channels are formed in the same space such that a plurality of data streams are transmitted in parallel by using these independent channels, so as to increase system capacity and improve spectrum utilization rate.

For an MIMO communication system, under the situation that a plurality of antennas are arranged closely in a space, received signals of the antennas therebetween have a correlation. The greater the correlation is, the lower the independence of each signal channel is, and the more obvious the deterioration influence on the overall transmission performance of the system is. Therefore, to effectively reduce the correlation between the antennas in the MIMO system and improve the isolation of the antenna is a key technical point for realizing high-speed data transmission of the MIMO system. With the further evolution of the technology, in order to support higher transmission rate, the latest LTE-Advanced standard (3GPP Release 12) has already supported a 4×4 MIMI technology, that is, four antennas are deployed on both a transmitting end and a receiving end, i.e., a base station and a mobile phone terminal, and the four antennas simultaneously work and there are not the primary and secondary points. It is required that each antenna has balanced radio-frequency and electromagnetic performance, and a lower correlation and a higher isolation are kept between all antennas.

On a base station side, since there is no strict requirement on the space occupied by base station antennas, the correlation between the antennas can be reduced by increasing the spacing between the antennas or by means of orthogonal polarization between the antennas. However, on a terminal side, especially on a mobilephone terminal, due to restriction of physical size, it is a very great technical challenge to deploy a plurality of antennas and keep lower correlation and higher isolation between the antennas. Terminal miniaturization demands prevent the isolation from being improved by increasing the spacing between the antennas, and small antenna radiation of the terminal usually has not an obvious polarization trend and thus it is very difficult to improve the isolation of the terminal antennas by means of simple orthogonal polarization. Thus, at a current stage, the terminal generally is provided with two antennas only, i.e., a main antenna and an auxiliary antenna, wherein, the main antenna is used independently for receiving and transmitting radio communication signals and the auxiliary antenna may work in an MIMO receiving mode to improve signal data transmission rate.

Traditional methods for improving isolation of terminal antennas generally are divided into three types: adopting different types of antenna combinations and different placing positions; increasing floor parasitic metal conductors or parasitic slit structures to change antenna mutual-coupling; and increasing decoupling lines/balancing lines/decoupling networks between antennas. Wherein the method of the first type is greatly restricted by intrinsic physical size of the terminal and it is difficult to apply in practice; and for the methods of the second and third types, the decoupling bandwidth is relatively very narrow, at present it is found that the effect is better mainly for above-2 GHz high frequency bands, such as LTE Band 7 (2500-2690 MHz), LTE Band 40 (2300-2400 MHz), etc. However, for LTE 700 MHz low frequency bands, such as LTE Band 12 (698-746 MHz), LTE Band 13 (746-787 MHz) and LTE Band 17 (704-746 MHz), the decoupling effect is not good and it is difficult to satisfy wide frequency band feature which is actually needed. At present, as considered by the academic community of antennas, the MIMO system requires the multi-antenna index of the terminal to be that the efficiency of a single antenna is above 40% and the isolation of any two antennas is above 15 dB. Therefore, when four LTE low frequency band antennas are deployed in a space where a handheld terminal is seriously limited, deploy, to guarantee higher isolation which needs to guarantee antenna efficiency and reduce coupling between the antennas becomes a key difficulty in 4×4 MIMO antenna design of the terminal.

SUMMARY

In order to solve the technical problem in the existing art, the embodiments of the present document mainly provide an antenna unit and a terminal, which can improve the isolation between anathemas.

The embodiment of the present document provides an antenna unit, comprising: an antenna circuit board, at least two neighboring antennas and an electromagnetic coupling module configured to isolate coupling signal transmission between two neighboring antennas, wherein the electromagnetic coupling module is connected in series between the two neighboring antennas.

Similarly, the embodiment of the present document further provides a terminal, comprising the antenna unit, a main circuit board and an operating circuit of the terminal, wherein the operating circuit of the terminal is arranged on the main circuit board of the terminal and the antenna unit is connected with the main circuit board.

The embodiments of the present document have the following beneficial effects:

The embodiments of the present document provide an antenna unit and a terminal, which can improve isolation between antennas and can be effectively applied in low frequency band antennas. The antenna unit provided by the embodiment of the present document comprises: an antenna circuit board, at least two neighboring antennas and an electromagnetic coupling module used for isolating coupling signal transmission between two neighboring antennas, wherein the electromagnetic coupling module is connected in series between the two neighboring antennas. The present document uses the electromagnetic coupling module to isolate signal transmission between two neighboring antennas, i.e., electric signals in the two antennas are unable to be transmitted to opposite end, thereby reducing signal coupling between the neighboring antennas and improving the isolation between the two neighboring antennas. Compared with the traditional parasitic metal conductor or slit structure and balancing line/decoupling line technologies, the antenna unit provided by the present document can overcome the disadvantage that the low-frequency bandwidth is narrow in the traditional high isolation technology, and the antenna unit has wider isolation bandwidth and is comparatively wide in application range

SPECIFIED EMBODIMENTS OF THE INVENTION

Figure 1:
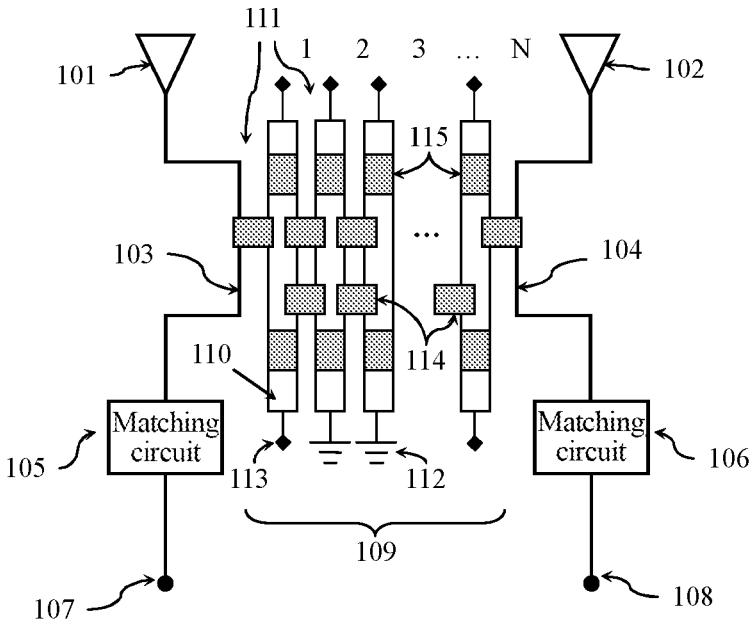
FIG. 1 is a structural schematic diagram of an antenna unit according to embodiment 1 of the present document.

In the existing multiple antennas, due to the existence of electromagnetic coupling, part of signals of neighboring antennas is transmitted to opposite end antennas by means of coupling, consequently antenna performance is decreased and a very great influence is caused on transmission performance. In consideration of reducing coupling between antennas to guarantee higher isolation, the present document provides an antenna unit, comprising: an antenna circuit board, at least two neighboring antennas and an electromagnetic coupling module used to isolate coupling signal transmission between two neighboring antennas, wherein the electromagnetic coupling module is connected in series between the two neighboring antennas. The embodiment of the present document uses the electromagnetic coupling module to make coupling signals between neighboring antennas unable to be transmitted to opposite end, the isolation between antennas is improved, the coupling between neighboring antennas is reduced and the antenna performance is guaranteed. Moreover, the antenna unit provided by the embodiment of the present document can overcome the disadvantage when the traditional isolation technology is applied to low-frequency antennas. The antenna unit provided by the embodiment of the present document is applicable to antennas of various frequency bands.

The present document will be further described below in detail through specified embodiments in combination with the drawings.

Embodiment 1

This embodiment provides an antenna unit, comprising: an antenna circuit board, at least two neighboring antennas and an electromagnetic coupling module used to isolate coupling signal transmission between two neighboring antennas, wherein the electromagnetic coupling module is connected in series between the two neighboring antennas. In this embodiment, the electromagnetic coupling module comprises an isolation metal structure and lumped parameter elements; and the isolation metal structure is respectively connected with the two neighboring antennas in series through the lumped parameter elements, the isolation metal structure includes at least one independent metal subpart, the metal subparts are connected through the lumped parameter element(s), one end of the metal subpart is floating or is open-circuited, and the other end of the metal subpart is grounded or short-circuited.

The antenna unit provided by this embodiment adopts the following isolation technology: the isolation metal structure is arranged between two neighboring antennas; the isolation metal structure includes N independent metal subparts; and a plurality of slits exist between the isolation metal structure and antenna traces. The lumped parameter elements (capacitor, inductor and resistor) for bridging are arranged on the slits and can connect the metal subparts and the neighboring traces of antennas; and the metal structure and the lumped parameter elements together form an electromagnetic coupling structure between dual antennas, and under the situation of resonance, the coupling of the antennas can be obviously reduced to improve the isolation between the dual antennas.

In this embodiment, the metal subpart is of a strip shape, a ring shape or other geometric shapes; and the lumped parameter element may be an adjustable electric control inductor or capacitor, and a control line of the adjustable electric control device may control the adjustable device through the end of the metal subpart.

Preferably, in this embodiment, the lumped parameter elements are connected with the independent metal subparts in series. In the antenna unit provided by this embodiment, the isolation metal structure and all the lumped elements together form an electromagnetic coupling structure between dual antennas. The electromagnetic coupling structure can be equivalent to an open-circuited state at operating frequency of antennas, so as to isolate electromagnetic coupling between two neighboring antennas.

As illustrated in FIG. 1 which illustrates a structure of an antenna unit provided by this embodiment, antennas 101 and 102 are two antennas which are mutually neighboring. The antenna 101 and the antenna 102 respectively have respective independent matching circuits 105 and 106. Feed points 107, 108 are respectively and electrically connected with the antenna 101 and the antenna 102. An isolation metal structure 109 for improving isolation is arranged between the antenna 101 and the antenna 102. The isolation metal structure 109 may includes 1-N mutually independent metal subparts, wherein a metal part 110 is an example of a metal subpart. Alternatively, a shape of the metal subpart 110 may be a strip shape, a ring shape or other geometric shapes. Antenna traces of the antenna 101 and the antenna 102 in FIG. 1 have a partial trace 103 and a partial trace 104 which are close to the isolation metal structure 109. Space slits 111 exist between the antenna trace 103, the antenna trace 104 and each metal subpart of the isolation metal structure 109. Two ends of each metal substructure may be in a form of grounding ends 112 or open-circuited ends 113. Alternatively, lumped parameter elements 114 (capacitor, inductor or resistor) may be bridged over the slits 111 between the metal subparts of the isolation metal structure 109 and the antenna traces 103 and the antenna traces 104. Alternatively, the metal subparts of the isolation metal structure 109 may be connected with lumped parameter elements 115 (capacitor, inductor or resistor) in series. In the antenna unit provided by this embodiment, by adding the isolation metal structure 109 between the two neighboring antennas, adjusting the physical parameters such as sizes and positions of the metal subparts 101 in the isolation metal structure 109, adjusting the lumped parameter elements 114 bridged on the slits 111 between metals and adjusting the lumped parameter elements 115 connected in series to each metal subpart 110, the purpose of improving the isolation between the neighboring antennas 101 and 102 is achieved. Further, the lumped parameter elements 114 and 115 in the isolation metal structure 109 may be adjustable electric control devices (such as adjustable capacitors and adjustable capacitors), so as to realize control of isolation with frequency. Under this situation, control lines and control signals (GPIO, SPI, MIPI, etc.) of the adjustable electric control devices may be fed through the grounding ends 112 or open-circuited ends 113 of the metal subparts. In an adjustable mode, when the antennas 101 and 102 operate at different systems and frequency bands, the isolation therebetween can be adjusted in real time and the wide-band high isolation performance is realized.

Figure 2:
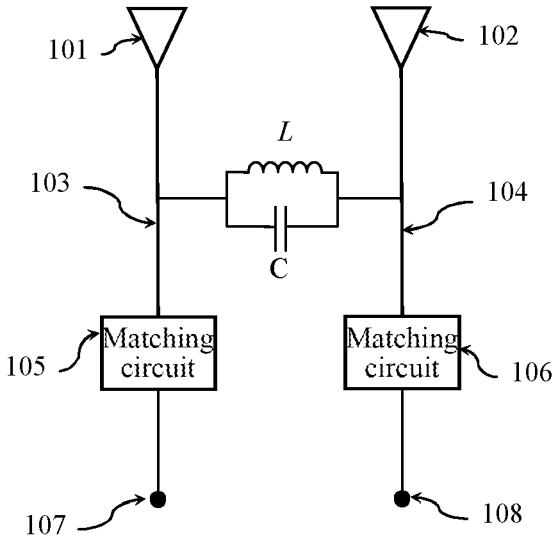
FIG. 2 is a principle schematic diagram of an antenna unit according to embodiment 1 of the present document.

As illustrated in FIG. 2, in the antenna unit provided by this embodiment, the isolation metal structure 109 is added between two neighboring antennas 101 and 102. The isolation metal structure includes N independent metal subparts, and slits exist between the antenna traces and each metal subpart. These metal slits, the lumped elements bridged on the slits and the lumped elements connected in series to the metal subparts together form a complex electromagnetic coupling structure between the antenna 101 and the antenna 102, which is used for eliminating coupling between the antennas so as to improve the isolation. Simply, the electromagnetic coupling structure is equivalent to a parallel resonance LC circuit. At the required operating frequency, parallel resonance is equivalent to an open-circuited state on the whole, so as to isolate the antenna 101 and the antenna 102, and the purpose of improving the isolation is achieved by reducing capacitive coupling between the antennas.

Figure 3:
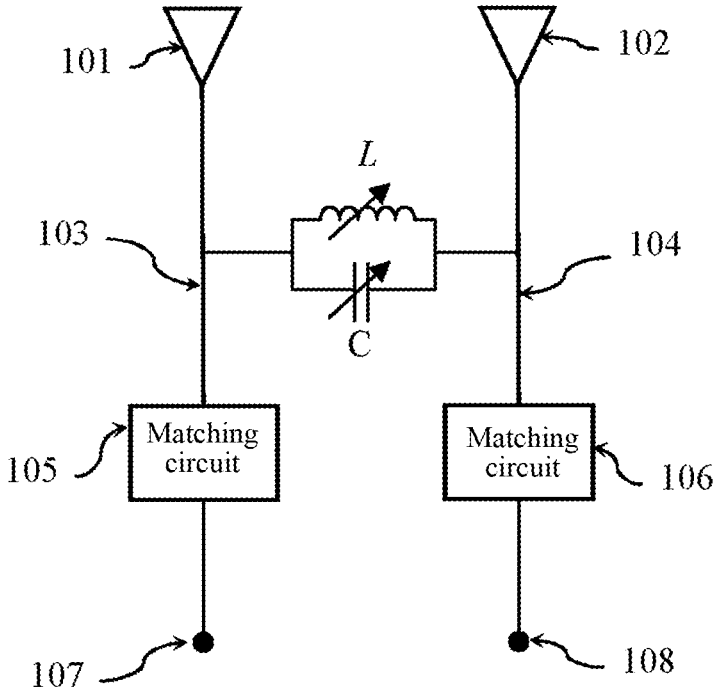
FIG. 3 is a principle schematic diagram of another antenna unit according to embodiment 1 of the present document.

As illustrated in FIG. 3, when the lumped parameter elements in the antenna unit comprise adjustable electric control devices, i.e., when the lumped parameter elements 114 and 115 in the isolation metal structure 109 in FIG. 1 are adjustable electric control devices, the adjustable control of sensitivity of neighboring antennas can be realized. In principle, by changing inductance L and capacitance C in the equivalent parallel resonance LC circuit, this embodiment realizes continuous adjustability of the operating frequency. The purpose of adjusting the isolation together with the operating frequency of the antennas in real time is achieved.

What is introduced through the above-mentioned contents is that N metal subparts and lumped parameter elements are arranged between neighboring antennas, the metal subparts and the lumped parameter elements form an electromagnetic coupling structure during operating, the coupling between the antennas is eliminated and thus the isolation is improved. Of course, in this embodiment, a parallel resonance LC circuit may be directly arranged between neighboring antennas to eliminate the coupling between the antennas, that is, the electromagnetic coupling module in the antenna unit provided by this embodiment may comprise a parallel resonance LC circuit, and the parallel resonance LC circuit in resonating may be equivalent to an open-circuited state on the whole, such that the signals in the two antennas cannot be transmitted to the opposite end antenna, the effect of isolating the antennas is achieved and the isolation between the antennas is improved.

Under normal circumstances, antenna traces are arranged in antenna clearance zones of the circuit board. In the antenna unit provided by this embodiment, the PCB comprises two antenna clearance zones, and at least two neighboring antennas are arranged in the antenna clearance zones. In this embodiment, the two antenna clearance zones may be not in the same plane by bending the antenna clearance zones. For example, when the clearance zones are arranged at upper and lower parts of the PCB, the two clearance zones are spatially folded, so as to make the entire PCB be an S shape to improve the isolation between any antennas and improve the radiation efficiency of the antennas.

Preferably, the antenna unit in this embodiment comprises a first antenna group and a second antenna group, the first antenna group and the second antenna group at least comprise two neighboring antennas, and the first antenna group and the second antenna group are arranged in different planes or the same plane of the antenna circuit board, wherein by arranging the antenna groups on different planes, the coupling of the antennas of each group can be reduced and the performance of the antennas of each group can be improved.

In order to further improve the isolation of the antennas, a plurality of slits may be further arranged in metal ground planes of a surface layer and a bottom layer of the PCB to increase the isolation. An optional slit shape may be L shape or T shape.

The antenna unit provided by this embodiment may be used as a terminal 4×4 MIMO antenna. Specifically, in this embodiment, the first antenna group comprises two neighboring antennas, the second antenna group comprises two neighboring antennas, the first antenna group is arranged at an upper part of a surface layer of the antenna circuit board and the second antenna group is arranged at a lower part of a bottom layer of the antenna circuit board; and the two antennas in the first antenna group are distributed in mirror symmetry with respect to a long axis of the antenna circuit board, and the two antennas in the second antenna group are distributed in mirror symmetry with respect to the long axis of the antenna circuit board. At this moment, the four antennas in the antenna unit may be LTE low frequency band antennas, the terminal 4×4 MIMO antennas guarantee the antenna efficiency and reduce the coupling between the antennas, and thus the isolation is guaranteed to be higher.

In the antenna unit provided by this embodiment, since the electromagnetic coupling structure which can be equivalent to an open-circuited state during operating is arranged between neighboring antennas, the coupling between the antennas is eliminated and the isolation is improved. In addition, the antenna unit provided by this embodiment can be applied to LTE low frequency band antenna design, and the problem of coupling of low frequency band antennas is effectively solved. For example, the antenna unit provided by this embodiment can be effectively applied to design of LTE low-frequency 700 MHz high-isolation antennas, the technical requirements of LTE-A in future on terminal antennas are satisfied and the miniaturization of antennas and terminals is guaranteed. The described terminal system solution can guarantee that the isolation of any two antennas in the entire 4 MIMO antennas is obviously improved, the integration with the circuit system is easy to realize and finally the performance index of 4×4 MIMO is realized on the miniaturized terminal.

Embodiment 2

Figure 4:
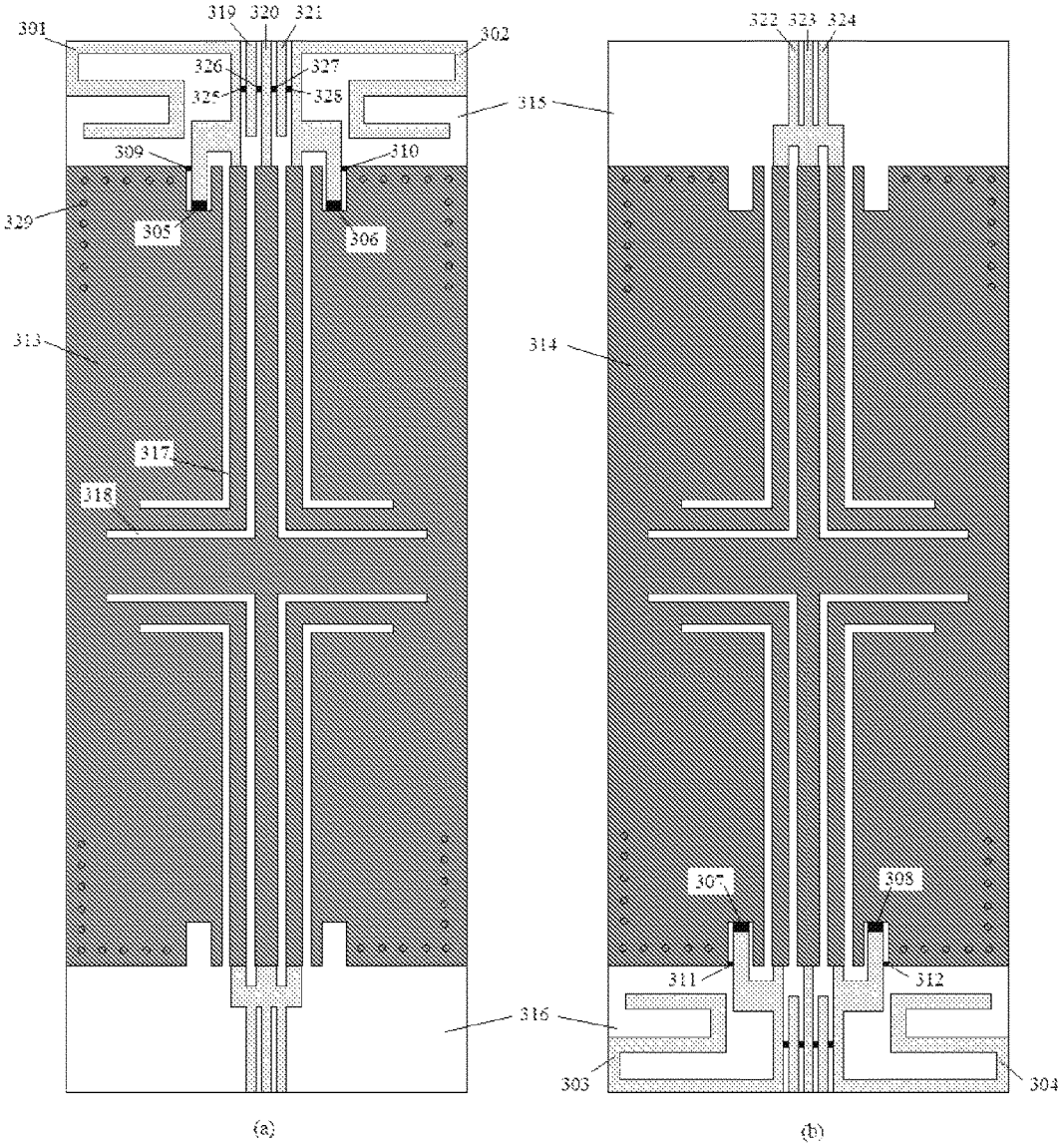
FIG. 4 is a schematic diagram of applying an antenna unit to LTE low frequency band 4×4 MIMO high-isolation antennas of a terminal according to embodiment 2 of the present document.

In this embodiment, the antenna unit is applied to LTE low frequency band 4 MIMO high-isolation antenna design of the terminal. Specifically, as illustrated in FIG. 4, the four antennas in this embodiment are Inverted F Antennas (IFAs) printed on two surfaces of a Planar Circuit Board (PCB). The size of the entire PCB is 80×210 mm, and the thickness is 1 mm. FIG. 4(*a*) illustrates a PCB surface layer trace form and FIG. 4(*b*) illustrates a PCB bottom layer trace form. As illustrated, traces of an antenna 1 (301 as illustrated) and an antenna 2 (302 as illustrated) are located at an upper part of a surface of a surface layer of the PCB and are distributed in mirror symmetry with respect to a long axis of the PCB. An antenna 3 (303 as illustrated) and an antenna 4 (304 as illustrated) are located at a lower part of a surface of a bottom layer of the PCB and are distributed in mirror symmetry with respect to the long axis of the PCB. Feed points 305, 305, 307, 308 are respectively and electrically connected with the four antennas 301, 302, 303, 304. The antenna 1 (301 as illustrated), the antenna 2 (302 as illustrated), the antenna 3 (303 as illustrated) and the antenna 4 (304 as illustrated) are respectively provided with corresponding matching circuits 309, 310, 311 and 312. The matching circuits used in this embodiment are parallel 2 pF capacitor devices. A metal ground plane 313 is on the surface layer of the PCB, a metal ground plane 314 is distributed in the bottom layer of the PCB, and the metal ground planes are used for providing radiation reference grounds for the four antennas. The physical size of the metal ground planes is 80×60 mm. In addition, the physical size of a clearance zone 315 of the antenna 301 and the antenna 302 and the physical size of a clearance zone 316 of the antenna 303 and the antenna 304 are 80×25 mm. In order to further improve the isolation between every two antennas of the four antennas, L-shaped metal slits are further formed in the metal ground plane 313 on the surface layer of the PCB and the metal ground plane 314 on the bottom layer of the PCB. Dual L-shaped metal slits corresponding to the antenna 1 (301 as illustrated) are 317 and 318. In this embodiment, the lengths of the slits 317 and 318 are respectively 86.3 mm and 102.5 mm, and the widths of the two slits are 1.7 mm. As illustrated, on the metal ground planes 313 and 314 of the PCB, the antennas 302, 303, 304 have the same and symmetrical slit distribution. Specifically, in this embodiment, the high-isolation metal structures are correspondingly metal strips 319, 320 and 321 between the antenna 301 and the antenna 302. The metal strips on the surface layer of the PCB are electrically connected with corresponding metal strips 322, 323, 324 on the bottom layer. It can be seen that the metal strip 320 is electrically connected with the metal ground plane 313 on the surface layer. The metal strips 322, 323, 324 are electrically connected with the metal ground plane 314 on the bottom layer. Accordingly, it can be seen that the metal subparts 319, 321 are in a single-end short-circuited/single-end open-circuited connection form; the metal subpart 320 is in a dual-end short-circuited connection form. Further, lumped parameter elements 325, 326, 327 and 328 are bridged on the slits of the antenna traces 301, 302 and the metal strips 319, 320, 321. In this embodiment, the lumped parameter elements 325 and 328 are 22 nH inductors, and the lumped elements 326 and 327 are 0.5 pF capacitors. Symmetrically, the same isolation metal strips and lumped parameter elements also exist between the antenna 303 and the antenna 304. Alternatively, the ground plane 313 on the surface layer of the PCB and the ground plane 314 on the bottom layer of the PCB may be electrically connected through via-holes 329 to form a uniform antenna ground plane.

To speak simply, an LTE Band 13 low-frequency 4 MIMO antenna illustrated by FIG. 4 adopts the isolation metal structure (319, 320, 321, 322, 323, 324, etc.) and lumped parameter elements (325, 326, 327, 328) to improve the isolation of neighboring antennas 301 and 302. By grouping the antennas 301, 302 and the antennas 303, 304 and locating traces on the surface layer and the bottom layer of the PCB, in combination with symmetrical arrangement of dual L-shaped slits on the ground plane 313 on the surface layer of the PCB and the ground plane 314 on the bottom layer of the PCB, the coupling between every two antennas in the 4 MIMO system is reduced, thus the isolation is improved and the radiation efficiency of each antenna is guaranteed.

Figure 5:
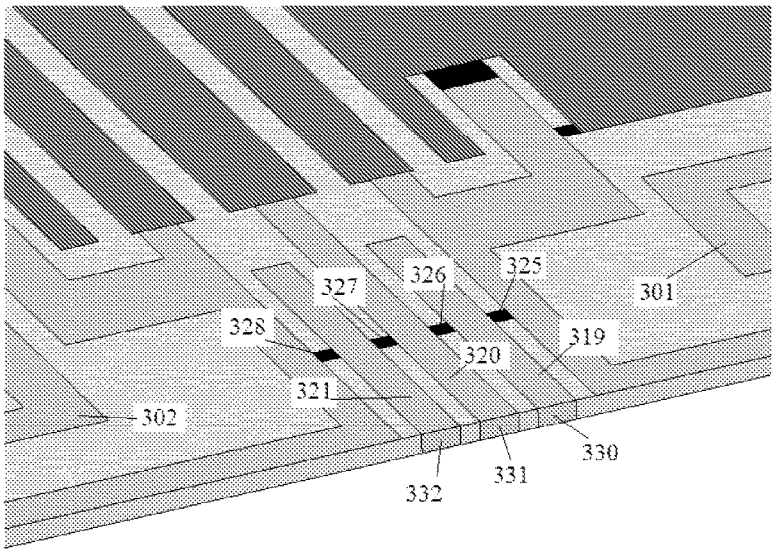
FIG. 5 is a schematic diagram of traces of two neighboring antennas at a thickness edge of a PCB dielectric board according to embodiment 2 of the present document.

FIG. 5 is a schematic diagram of traces of two neighboring antennas of the example illustrated by FIG. 4 at a thickness edge of a PCB dielectric board. Specific isolation metal strips 319, 320, 323 on the surface layer are respectively and electrically connected with metal strips 322, 323, 324 on the isolation ground plane of the bottom layer through metal strips 330, 331, 332 on the side edge. Alternatively, the metal strips 319, 320, 323 on the surface layer may also be electrically connected with the metal strips 322, 323, 324 on the bottom layer through via-holes.

Figure 6:
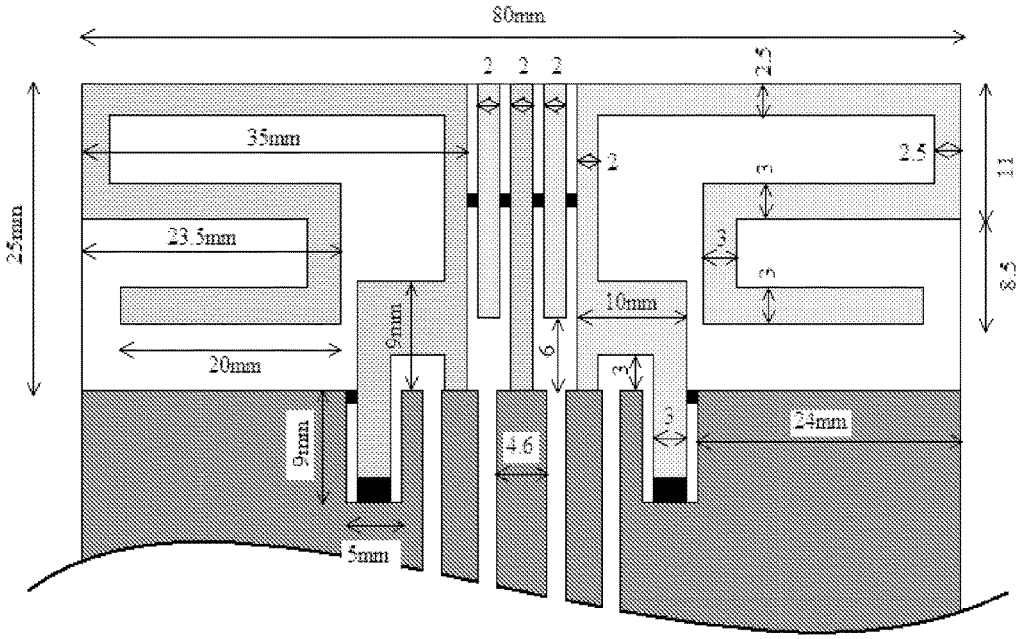
FIG. 6 is a schematic diagram of physical sizes of key traces of two neighboring antennas according to embodiment 2 of the present document.
Figure 7:
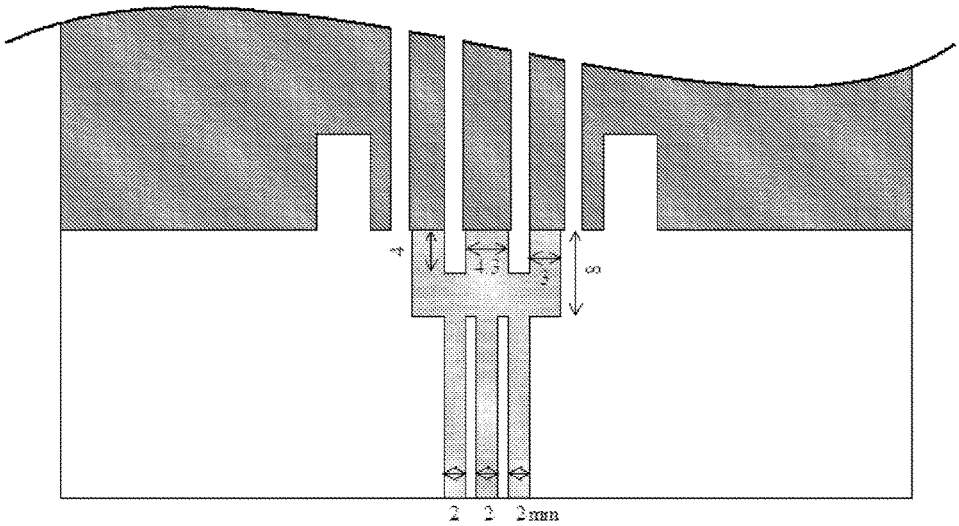
FIG. 7 is a schematic diagram of physical sizes of back traces of two neighboring antennas according to embodiment 2 of the present document.

FIG. 6 and FIG. 7 are schematic diagrams of physical sizes of key traces of two neighboring antennas of the example illustrated by FIG. 4. Unit of numerical values therein is millimeter. Since the four IFA antennas of this example are in a fully symmetrical form, all physical sizes are the same.

Figure 8:
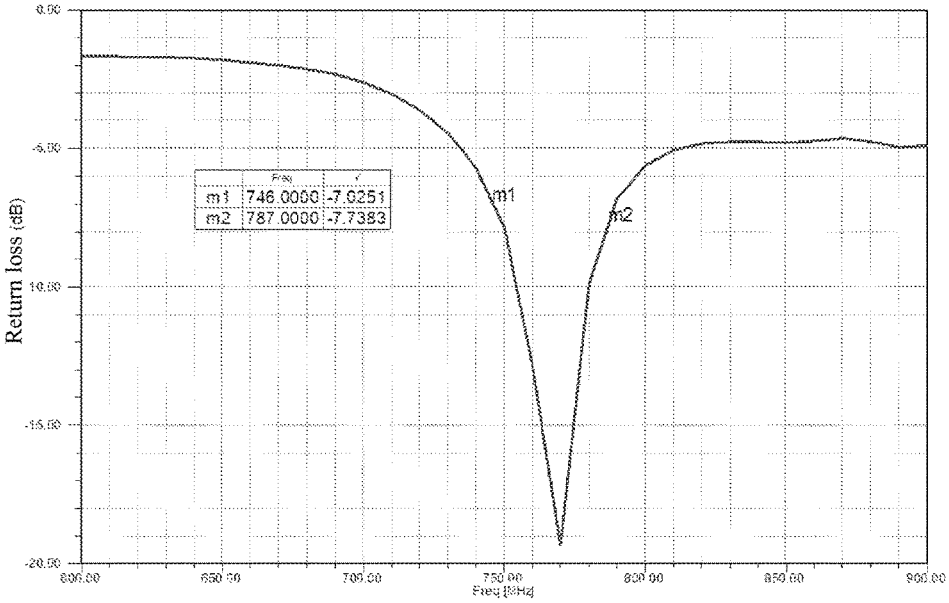
FIG. 8 is a schematic diagram of a reflection coefficient of a simulation for a single antenna according to embodiment 2 of the present document.
Figure 9:
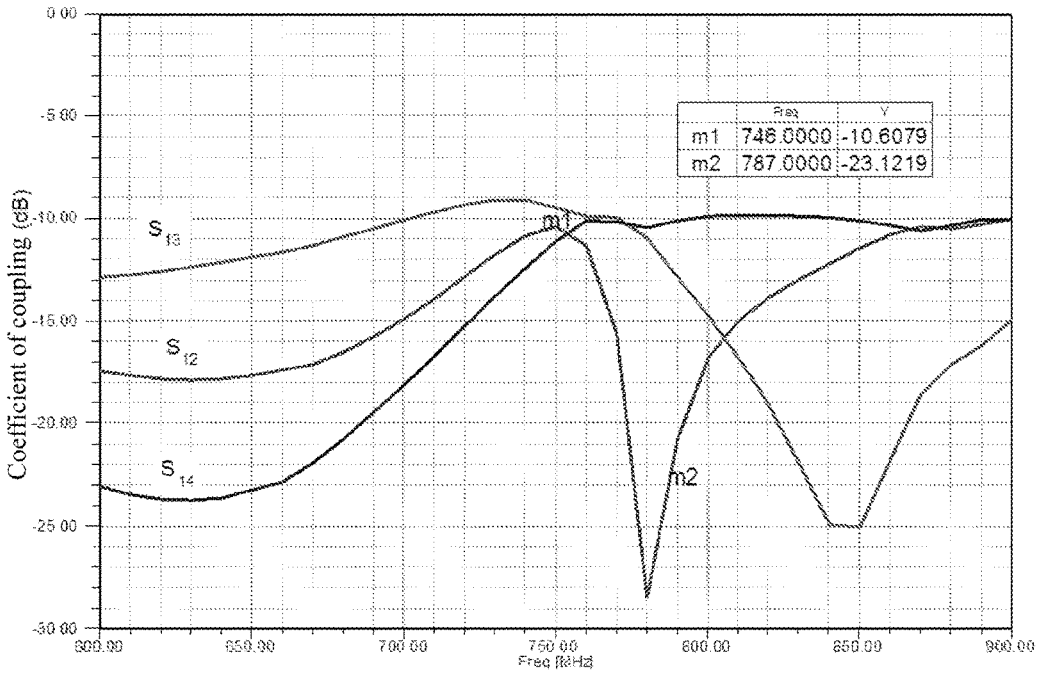
FIG. 9 is a schematic diagram of coupling coefficients of a simulation for four antennas according to embodiment 2 of the present document.

Since the four antennas are fully symmetrical, FIG. 8 only illustrates return loss of a single antenna of the example through a simulation. From FIG. 8, it can be seen that single-antenna resonance is within a frequency range of LTE Band 13 (746-787 MHz). Through actual jig measurement, the efficiency of the four antennas of the example in FIG. 4 is about 40%. FIG. 9 illustrates coupling coefficients (isolation and S parameter) between the four antenna units of the example in FIG. 4 through a simulation. From FIG. 9, it can be seen that, since the high isolation technology of the present document is adopted, the isolation between two neighboring antenna 1 (301 as illustrated) and antenna 2 (302 as illustrated) basically has already reached 15 dB, while the isolation between the antenna 1 (301 as illustrated) and the antenna 3 (303 as illustrated) and the isolation between the antenna 1 (301 as illustrated) and the antenna 4 (304 as illustrated) have already reached 11 dB. Through actual jig measurement, the isolation between the antenna 1 and the antenna 2 at LTE Band 13 has already been greater than 15 dB, while the isolation between the antenna 1 and the antenna 3 and the isolation between the antenna 1 and the antenna 4 are between 12 dB and 13 dB.

Figure 10:
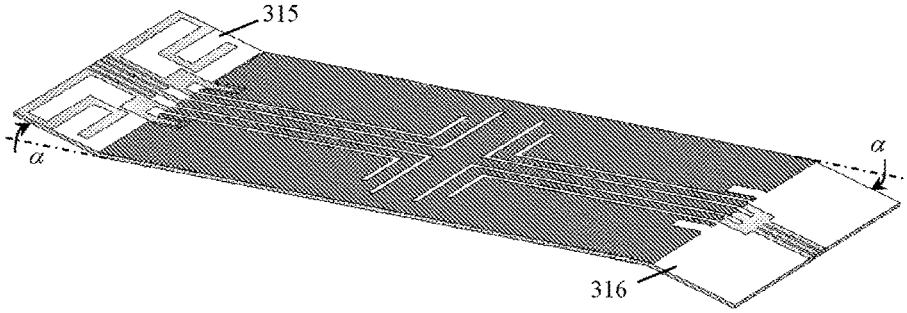
FIG. 10 is a schematic diagram of a four-antenna system according to embodiment 2 of the present document.

Further, in order to improve the isolation between every two antennas of the example illustrated by FIG. 4, the antenna clearance zones 315 and 316 may also be folded by rotating with an a angle towards two directions, as illustrated in FIG. 10. At this moment, the side view of the entire PCB is S-shaped. Since the antennas 301, 302 and the antennas 303, 304 are located on different surfaces of the PCB, by bending for a certain angle, the directivity of the antennas is temporally changed, and the spatial radiation coupling of the antennas can be further reduced. By adopting this solution, final actual jig measurement results are that the isolation between any two antennas is greater than 15 dB and the single antenna efficiency is guaranteed to be about 40%.

Embodiment 3

Figure 11:
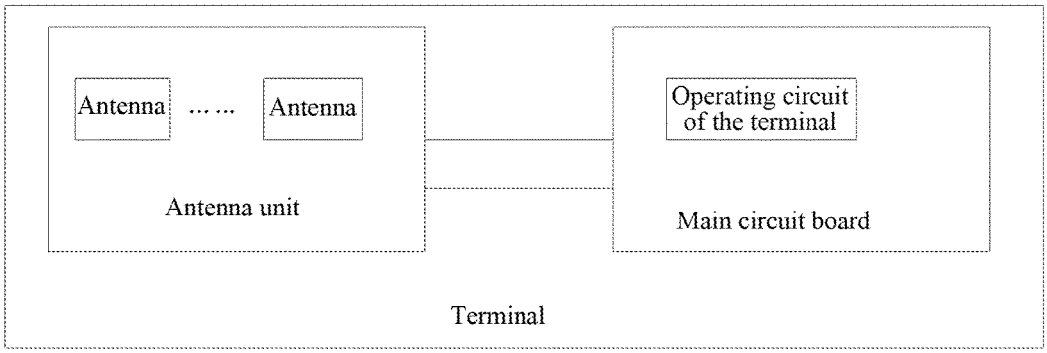
FIG. 11 is a structural schematic diagram of a terminal according to embodiment 3 of the present document.

As illustrated in FIG. 11, this embodiment provides a terminal, comprising the antenna unit provided by embodiment 1 or embodiment 2, a main circuit board and an operating circuit of the terminal, wherein the operating circuit of the terminal is arranged on the main circuit board of the terminal and the antenna unit is connected with the main circuit board.

In order to reduce signal interference between antennas on the antenna circuit board and the operating circuit on the main circuit board, at the terminal provided by this embodiment, a spacer may be arranged between the main circuit board and the antenna mainboard.

Figure 12:
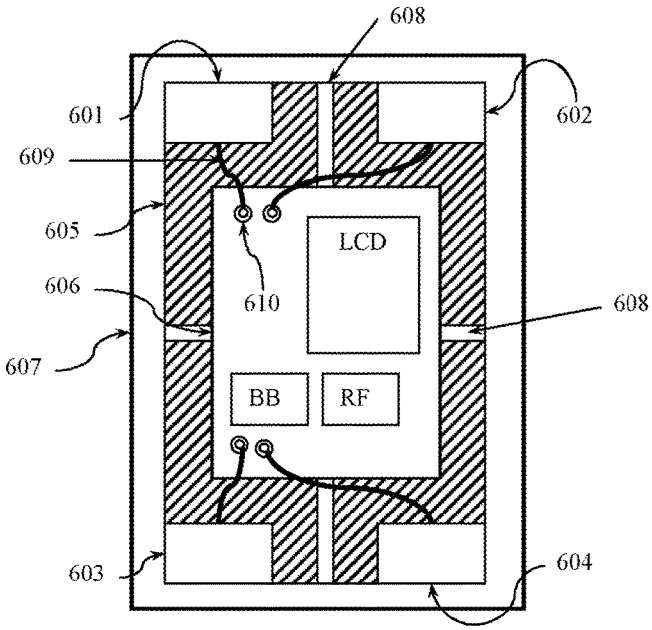
FIG. 12 is a top view of antennas and operating circuit arrangement of a four-antenna terminal according to embodiment 3 of the present document.
Figure 13:
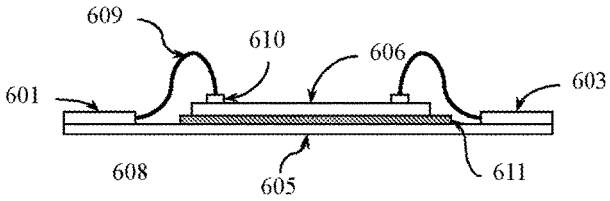
FIG. 13 is a side view of antennas and operating circuit arrangement of a four-antenna terminal according to embodiment 3 of the present document.

As illustrated in FIG. 12 which is a schematic diagram of a four-antenna terminal provided by this embodiment, due to the difficulty in the design of LTE low-frequency 700 MHz 4 MIMO antennas, in order to guarantee the high isolation between any two antennas, the high isolation technology of the present document is adopted and slitting treatment needs to be performed in the metal ground planes of the PCB. Consequently, the layout and traces of the circuit of the terminal are influenced. In order to solve the problem, aiming at the 4 MIMO high-isolation antenna solution, a solution that the antenna ground plane and the circuit ground plane are separated may be adopted. Specifically, as illustrated in FIG. 12, antennas 601, 602, 603, 604 are symmetrically distributed on a mainboard 605 of the PCB of the antenna. A slit 608 for guaranteeing the isolation is in the ground plane of the PCB mainboard of the antenna. A terminal Base Band (BB) circuit, a Radio Frequency (RF) circuit and an LCD display unit are located on an independent circuit mainboard 606. The circuit mainboard is provided with a radio frequency connector connected with the antennas and the radio frequency connector is connected with antenna feed points through radio frequency cables. Specifically, the antenna 601 is connected with a radio frequency connector 610 on the circuit mainboard 606 through a radio frequency cable 609 to realize the effect of transmitting and receiving signals. All components are included in a terminal box 607. FIG. 13 is a side view of a four-antenna terminal system. As illustrated, in order to guarantee that no mutual interference is caused between the antenna mainboard 605 and the circuit mainboard 606, a spacer 611 needs to be added therebetween. Alternatively, the spacer 611 is an insulated flexible thin film or a plastic support material. Through the terminal antenna design solution, the functional requirements of the 4×4 MIMO terminal can be satisfied.

The above-mentioned contents are used for further describing the present document in detail in combination with the specific embodiments, and the specific embodiments of the present document shall not be considered as a limit on the description. One ordinary person skilled in the art can make multiple simple deductions or replacements without departing from the concept of the present document. However, all these deductions or replacements shall also be considered within the protection scope of the present document.

What is claimed is:

1. An antenna unit, comprising: an antenna circuit board, at least two neighboring antennas (101, 102) and an electromagnetic coupling module (109) configured to isolate coupling signal transmission between two neighboring antennas (101, 102), wherein the electromagnetic coupling module (109) is connected in series between the two neighboring antennas (101, 102);

wherein the electromagnetic coupling module comprises an isolation metal structure (109), a first lumped parameter elements (114) and a second lumped parameter elements (115);

wherein the isolation metal structure (109) is respectively connected with the two neighboring antennas (101, 102) in series through the lumped parameter elements (114, 115), the isolation metal structure (109) comprises at least one independent metal subpart (110), the independent metal subparts (110) are connected through the first lumped parameter element(s) (114), one end (113) of the independent metal subpart (110) is floating or is open-circuited, and another end (112) of the independent metal subpart (110) is grounded or short-circuited;

wherein the second lumped parameter element (115) is connected in series in the independent metal subpart (110).

2. The antenna unit according to claim 1, wherein the lumped parameter element comprises an adjustable electric control device and a control line of the adjustable electric control device performs self-control through an end of the metal subpart.

3. The antenna unit according to claim 2, wherein the antenna circuit board comprises two antenna clearance zones, said at least two neighboring antennas (101, 102) are arranged in the antenna clearance zones and the two antennas clearance zones are in different planes.

4. The antenna unit according to claim 2, wherein the antenna unit comprises a first antenna group and a second antenna group, the first antenna group and the second antenna group at least comprise said at least two neighboring antennas (101, 102), and the first antenna group and the second antenna group are arranged in different planes or the same plane of the antenna circuit board.

5. The antenna unit according to claim 1, wherein the antenna circuit board comprises two antenna clearance zones, said at least two neighboring antennas (101, 102) are arranged in the antenna clearance zones and the two antennas clearance zones are in different planes.

6. The antenna unit according to claim 1, wherein the antenna unit comprises a first antenna group and a second antenna group, the first antenna group and the second antenna group at least comprise said at least two neighboring antennas (101, 102), and the first antenna group and the second antenna group are arranged in different planes or the same plane of the antenna circuit board.

7. The antenna unit according to claim 6, wherein the first antenna group comprises said at least two neighboring antennas (101, 102), the second antenna group comprises said at least two neighboring antennas (101, 102), the first antenna group is arranged at an upper part of a surface layer of the antenna circuit board and the second antenna group is arranged at a lower part of a bottom layer of the antenna circuit board; and the at least two neighboring antennas (101, 102) in the first antenna group are distributed in mirror symmetry with respect to a long axis of the antenna circuit board, and the at least two neighboring antennas (101, 102) in the second antenna group are distributed in mirror symmetry with respect to the long axis of the antenna circuit board.

8. A terminal, comprising the antenna unit according to claim 1, a main circuit board and an operating circuit of the terminal, wherein the operating circuit of the terminal is arranged on the main circuit board of the terminal and the antenna unit is connected with the main circuit board.

9. The terminal according to claim 8, wherein the terminal further comprises a spacer; and the spacer is arranged between the main circuit board and an antenna mainboard.

* * * * *